US005135030A

United States Patent [19]

Schoen

[11] Patent Number: 5,135,030

[45] **Date of Patent: * Aug. 4, 1992**

[54] ELECTROHYDRAULIC CONTROL SYSTEM

[76] Inventor: Hans Schoen, Lange Horst 87, 4320 Hattingen, Fed. Rep. of Germany

[ * ] Notice: The portion of the term of this patent subsequent to May 4, 2007 has been disclaimed.

[21] Appl. No.: 155,233

[22] Filed: Feb. 12, 1988

[30] Foreign Application Priority Data

Feb. 12, 1987 [DE] Fed. Rep. of Germany ..... 3704312

[51] Int. Cl.[5] ..... F15B 13/043

[52] U.S. Cl. ..... 137/625.63; 91/365; 137/625.64

[58] Field of Search ..... 91/365; 137/625.63, 137/625.64

[56] References Cited

U.S. PATENT DOCUMENTS

| | | | |
|---|---|---|---|
| 3,339,573 | 9/1967 | Bahniuk | 137/625.64 X |
| 3,442,282 | 5/1969 | Murphy | 91/365 X |
| 3,698,437 | 10/1972 | Cox | 137/625.64 X |
| 3,747,570 | 7/1973 | Versari et al. | 137/625.64 |
| 3,757,823 | 9/1973 | Knutson | 137/625.64 |
| 4,762,147 | 8/1988 | Sloate | 137/625.64 |

*Primary Examiner*—Gerald A. Michalsky
*Attorney, Agent, or Firm*—Clifford A. Poff

[57] ABSTRACT

A control system for a hydraulic drive element such as a cylinder for a press includes a pilot valve having a plurality of fluid outlets controlled by a pilot valve spool unidirectionally biased by a resilient spring at one end thereof to a neutral position. A main valve having an elongated main valve spool resiliently biased to a center position. The opposite ends of the main valve spool are contiguous with individual pressure chambers separately connected to one of the plurality of outlets of the pilot valve. A link engaged with an end of the pilot valve spool which is opposite the end engaged by the resilient spring. A set value drive including stepping motor is coupled to the link for moving the pilot valve spool in either of opposite directions from the neutral position. The link is coupled for movement by the main valve spool to return the pilot valve spool to the neutral position.

7 Claims, 3 Drawing Sheets

VL
RL
M
Q

ELECTROHYDRAULIC CONTROL SYSTEM

BACKGROUND OF THE INVENTION

1. Field of the Invention

This invention relates to an electrohydraulic control system for controlling a hydraulic drive element such as a cylinder of a press, and, more particularly, to such a control system having a stepping drive operative to move a link which in turn is coupled to move a spool member of each of a pilot valve and a main valve for controlling the delivery of pressing fluid to the drive element.

2. Description of the Prior Art

Various constructions of electrohydraulic control systems are known in this art as proportional dividers because of the nature of the operation of the system. In the known system, the means for actuating a pilot valve spool can take the form either of two proportional magnets which engage opposite end faces of the spool or of a single such magnet in which event the spool is spring biased at one end. To actuate the proportional valve, signals in a digital form must be converted into analogue voltage values. The conversion of signals from a digital to analogue is a very elaborate procedure which cannot be accomplished without deviations particularly in the degradtion performance of certain control functions. Moreover, in the conversion process, operating points cannot be reproduced in a manner which is free from deviations. Such deviations are a severe disadvantage particularly in the control of a numerically controlled hydraulic press because the unavoidable deviations lead to variations in the positioning of the press ram.

It also has been found in practice that proportional valves manifest a temperature dependent behavior pattern. Consequently, a proportional valve cannot be used to control a hydraulic press with a constant accuracy throughout a working day; thus also undesired variations to the quality of the end product. Also, the known proportional valves are sensitive to dirt, and systems which use proportional valves cannot operate without losses. Still a further disadvantage arises out of the absence of a feedback between set values and actual values when using proportional valves.

SUMMARY OF THE INVENTION

It is a object of the present invention to provide an electrohydraulic control system which will overcome the short comings and disadvantages of known control systems discussed hereinbefore.

It is a further object of the present invention to provide an electrohydraulic control system operative for very accurate positioning of a hydraulic drive element such as a cylinder of a press with very accurate repositioning reproducibility even at different speeds of operation.

A further object of the present invention is to provide an electrohydraulic control system which can be economically produced and directly connected to a conventional numerical control or computerized numerical control system in a very efficient and simple manner.

More particularly, according to the present invention there is provided an electrohydraulic control system including a pilot valve having a spool spring biased at one end and engaged at the opposite end with a movable link which is moveable by a set value drive, the link being positionable in a neutral position and moveable therefrom by movement of the pilot valve spool in either opposite longitudinal directions thereof, and a main valve having a main valve spool movable by the link for returning the pilot valve spool to the initial neutral position thereof.

Preferably, the electrohydraulic control system of the present invention provides that the set value drive takes the form of a apparatus which includes an electric set value stepping motor. It is particularly advantageous to provide according to the present invention, that the set value drive includes a numerically controlled stepping motor to actuate the pilot valve spool. The control arrangement provided by the apparatus of the present invention provides that a relatively low power stepping motor can be utilized to impart control in the system in the form of a mechanical value such that the main spool valve is moved hydraulically by mechanical actuation of the pilot valves. Due to the mechanical reaction of the main valve spool on the pilot valve and stepping motor, a closed loop position control circuit is formed wherein the pilot valve causes the main valve spool to follow-up in response to the adjustments produced by the stepping motor. Dependent upon the particular design of the apparatus, forces which can be as high as required are available at the spool thus insuring accurate and reliable adjustments of the main valve under all operating conditions.

The set value can be obtained by a relatively low power drive which enables the use of dynamically high grade set value stepping motors. Response and adjustments times are corresponding short, also very short positioning times can be achieved to the extent permitted by the design of the drive element to be controlled.

Additional developments according to the present invention provide in a simple way, two channel actuation for emergency stopping by the pilot valve supplied with pressurized oil for establishing a ready state of operation by the control system. The supply of pressurized oil is switched ON and OFF by way of a solenoid valve. When the solenoid of the valve is deenergized, springs acting on the ends of the main valve spool automatically move the spool to a central position and maintain the spool at this position, while at the same time the position of the stepping motor is immaterial. The pilot valve is inoperative. In an emergency stop situation, in addition to the stepping motor, assuming a neutral function, the solenoid of the solenoid valve is switched OFF, thus assuring that the stoppage can be made even without operation of the numerical control system.

Another important advantage arising out of the present invention over a proportional valve system of the type known in the art, is that the present invention provides that even when the main valve assumes a fully opened position, the spool thereof does not strike a mechanical abutment, but instead, the spool is in all positions thereof, retained solely in position by the pressurized medium. This feature obviates the noises which is unavoidable in a proportional valve arrangement and occur when the spool strikes a mechanical stop.

In the present invention, the control system mainly comprises a stepping motor, a pilot valve, a link and a main valve whereby the system is arranged in a simple and overseeable construction. The pilot valve can be moved manually by means of the link without action by a numerical control. Thanks to the overseeablility of the components, the complete system is easy to service and lends itself to simple fault diagnosis.

These features and advantages of the present invention as well as others will be more fully understood when the following description is read in light of accompanying drawings in which:

FIG. 1 is a circuit diagram of an electrohydraulic control system according to the present invention for controlling the cylinder of a press;

FIG. 2 is a side-elevational view, partly in section, of a main valve, pilot valve and stepping motor; and FIG. 3 is an end elevational view is taken along lines III—III of FIG. 2.

BRIEF DESCRIPTION OF THE DRAWINGS

The lever 9 engages at its end, which is opposite the pivot head 8, with a cam roller 10 eccentrically mounted on a rotatably disc 11. The disc 11 is connected to the output shaft of a motor 4. When necessary or desirable, the disc 11 can be connected by way of a reduction drive transmission to the output shaft of the motor. In FIG. 1, a roller 10 is shown in a neutral position. From this position the roller can be pivotally positioned approximately 90 degrees in either direction. A tension spring 13, best shown in FIG. 2, extends between the lever 9 and a cam roller spindle 12 to insure that contact is made between the roller 10 and the lever 9 when the disc 11 rotates clockwise.

Figure 1:
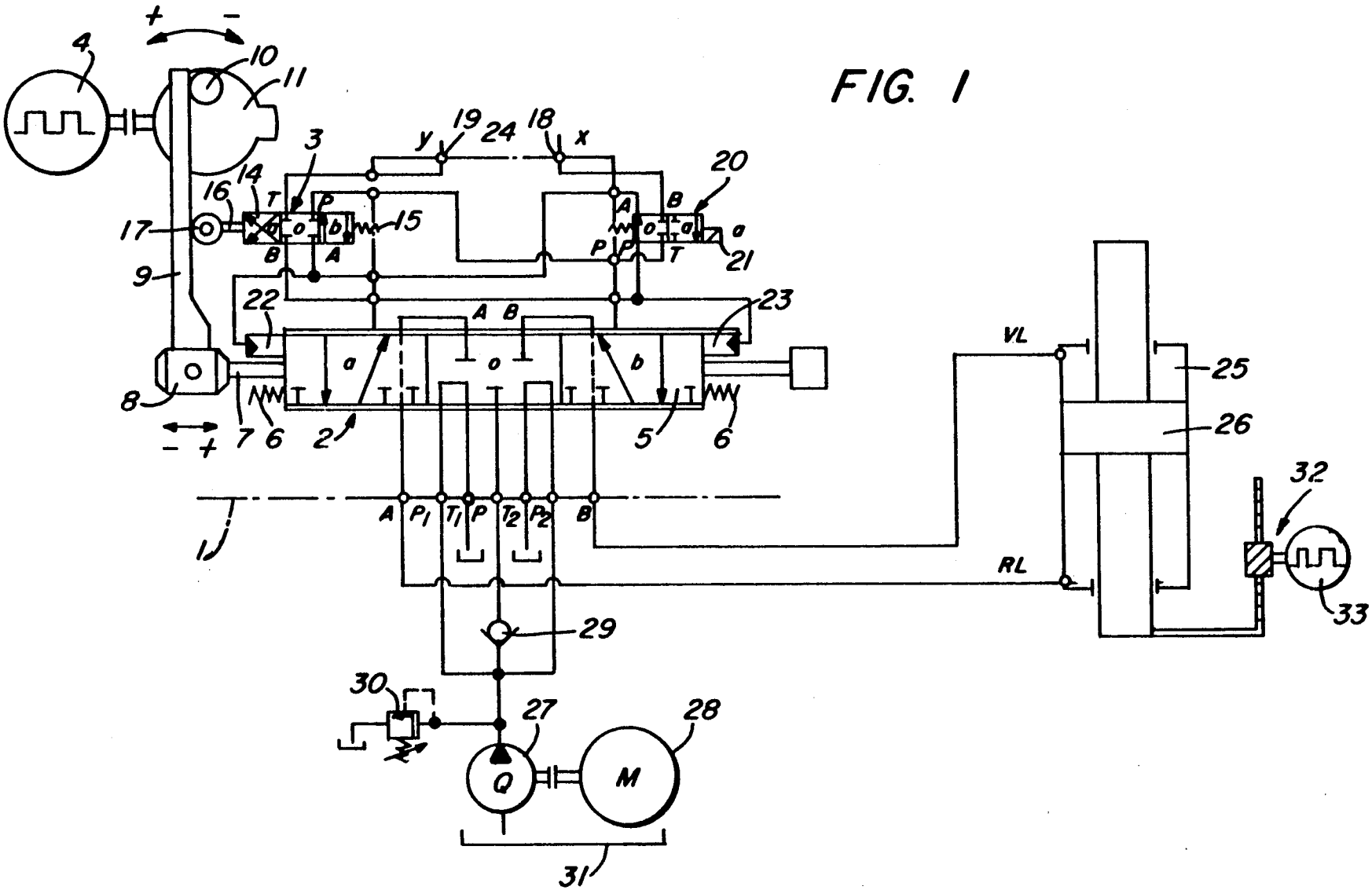
In FIG. 1 there is illustrated an electrohydraulic control system of the present invention. In this system, there is shown above a chain dotted line identified by reference numeral 1, a seven-way, three position diverter which forms a main valve 2, a known four-way, two position diverter forming a pilot valve 3 and a known set value stepping motor 4. A main valve spool 5 is centered by the operation of compression spring 6 and 6' which are operatively arranged one on each of the respective ends of the main valve spool 5. A rod 7 is rigidly connected to the spool 5 and extends outside the valve to one end and carries a pivot head 8 to which a generally transverse single armed lever 9 is pivotally connected.
Figure 2:
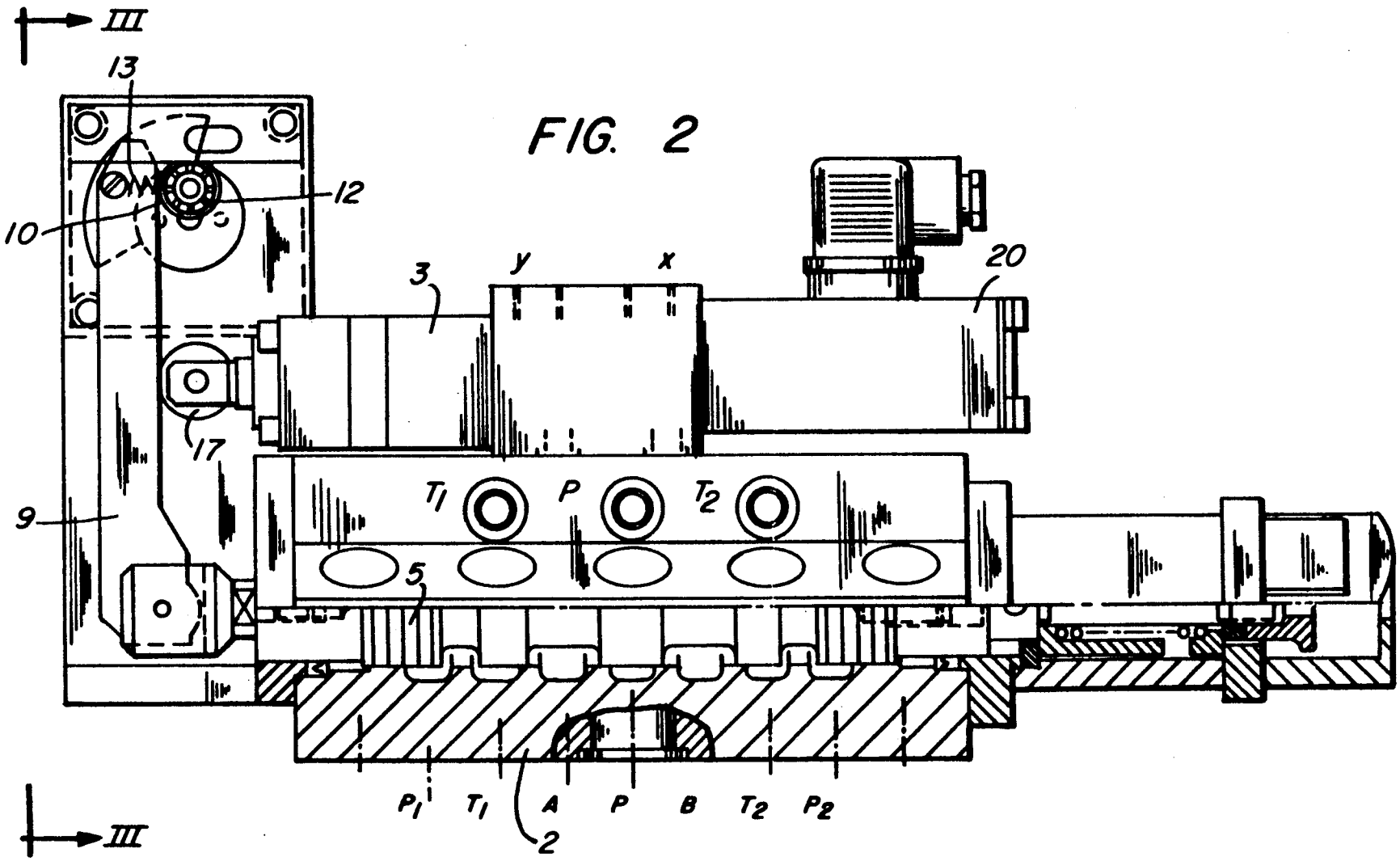

A pilot valve 3 is located parallel and adjacent to the main valve 2. The pilot valve includes a pilot valve spool 14 biased at one end by a compression spring 15. A rod 16 is rigidly connected to the spool 14 at its end which is opposite the location of spring 15. The rod 16 extends outside the valve and carries at its free-end a rotatably mounted duplicating roller 17. The pilot valve spool 14 is shown in FIG. 1 and 2 in its central or neutral position. Depending upon the direction of pivotal movement by lever 9, the pilot valve spool 14 moves to a varying extent from its central position to the left and the right hand directions as one views FIGS. 1 and 2. An independent source of pressurized oil, not shown, is supplied to pilot valve 3 which includes a connection 18 for a flow line and a connection 19 for a return line. From connection 18 there is a line which extends to a solenoid valve 20, embodied as a four-way, two-way position diverter, to the pilot line of valve 3. The valve 20 includes a solenoid 21 which remains deenergized when the valve 20 is in the OFF position as illustrated in the drawings. The output T of valve 20 is connected to input P of the pilot valve 3 while the output T of the pilot valve extends directly to the return connection 19. Two other connections, A and B, of the pilot valve 3 are connected to pressure chamber 22 at one end of the main valve 2 and to pressure chamber 23 at the opposite end thereof.

The solenoid valve 20 operates to open and shut OFF the supply of pressurized oil to the pilot valve 3 and further functions to provide a direct communication between pressure chambers 22 and 23 by a direct connection between these chambers formed by lines extending to the solenoid valve at connections P and A which, as shown in the drawings, are innerconnected in the OFF position; thereby providing direct communication between the chambers 22 and 23. Consequently, when the spring 6 and 6' center the main valve spool 5, pressure can equalize between the two chambers 22 and 23.

Advantageously, the pilot valve 3 and the solenoid valve 20 are structurally combined. In such a combined construction, the connecting lines within the chain-dotted rectangle identified by reference numeral 24 take the form of internal ducts for the flow of oil. The main valve 2 is provided with a main control side having three pump connections, P, P1, and P2; two tank or reservoir connections T1 and T2; and two connections A and B for flow line VL and return line RL, respectively, of a press cylinder 25 having a drive piston 26. The cylinder 25 is supplied with pressurized oil from an oil pressure pump 27 driven by a motor 28 and connected to input P by way of a check valve 29. Also, the pump 27 is directly connected to main valve inputs P1 and P2. In an oil supply line between pump 27 and input lines Pl and P2 and check valve 29, there is pressure limiting valve 30. The connections T1 and T2 extend to an oil reservoir 31.

Also shown in FIG. 1 is a position sensor system 32 which is of a type known in the art and is connected to the piston 26 of the pres for operation to detect the actual position of the piston. The system 32 includes a generator 33 which produces digital signals corresponding to the position of the press piston. The digital signals correspond to actual values which are fed to the stepping motor 4 as appropriate input values for controlling the motor 4 and for continuous comparison between set values and actual values. The electrohydraulic control system of the present invention include by way of the press cylinder 25 a digital absolute position sensor system 32 and 33, and the electronic control of a closed control loop.

Figure 3:
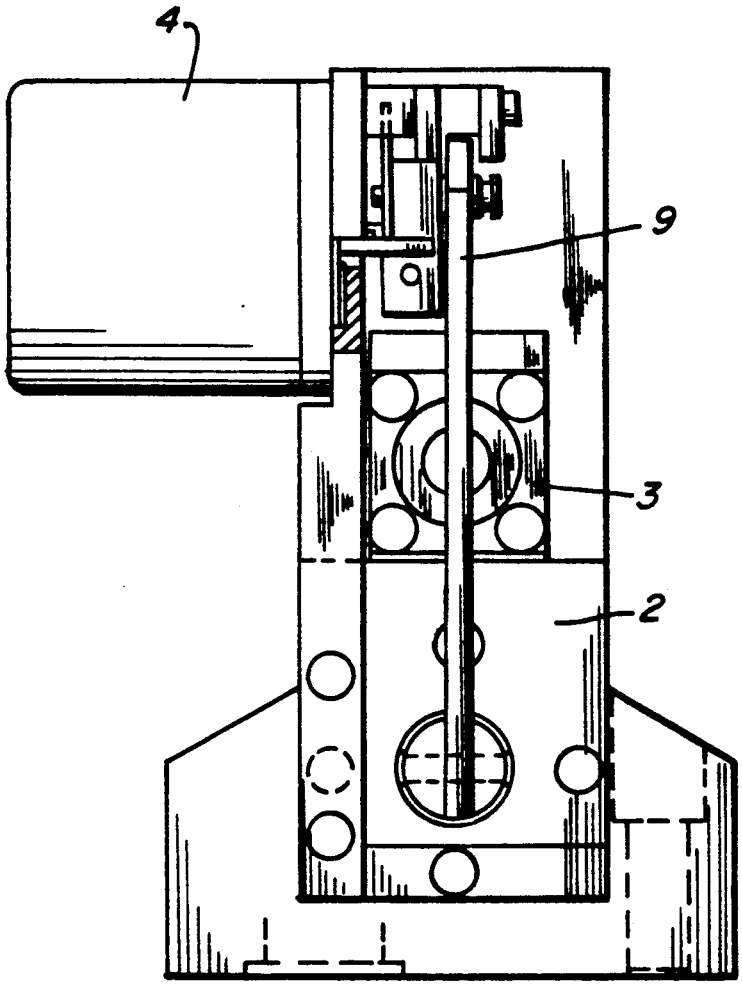

The following is a basic description of the operation of the basic electrohydraulic control system of the present invention as just described and shown in FIGS. 1-3 in the drawings. The motor 4 is activated by a known numerical control system Rotation of the motor 4 produces a resulting rotation of the disc 11 which acts by way of cam roller 10 to move the lever arm 9 in one direction or the other. The movement of the lever 9 is associated with a mechanical actuation of the pilot valve 3, i.e., a movement of the pilot valve spool 14 in one or the other directions of the elongated lengths of the spool. In the event the spool 14 is moved to the left, as one views FIGS. 1 and 2, the pilot circuit oil pressure supplied to connection 18 flows through the energized valve 20 to the main valve pressure chamber 22. The main valve spool 5 shows, in a right-hand direction, to produce communication between, on the one hand, the connections or ports P and B, and on the other hand, connections A and T1. The press cylinder piston 26 therefore descends as one views FIG. 1.

Simultaneously, as the main valve spool 5 moves in a right hand direction, the bottom end of lever 5 also moves in a right hand direction such that lever 9 pivots around the place of contact between its free end and the roller 10. The pilot valve spool 14 returns to an initial neutral position because of the pivotally movement by way of the duplicating roller 17 and the pilot valve spool 14, thus interrupting the supply of pressurized oil to chamber 22. The control event initiated thereby terminates. In the event control is initiated by movement of the pilot valve spool 14 to the right, main spool valve 5 shifts to the left and produces delivery of oil to move the press cylinder piston 26 upward. When the supply of oil to chamber 23 terminates, the initiated control event terminates.

The feedback from the main valve 2 to pilot valve 3 by way of lever 5 is so designed that movement of main valve spool 5 cancels the earlier control movement of the pilot valve spool 14. This means, for example, that a maximum deflection of the main valve spool 5 returns the pilot valve spool 14 from its previous position of maximum deflection to its central position.

As in the case of a conventional diverter the main valve spool 5 assumes the following clearly defined positions: a central position wherein the spool 5 is in its central position which is illustrated in FIGS. 1 and 2 of the drawings; position a, wherein the spool is displaced to its maximum stroke in direction a; and position b, wherein the spool is displaced through a maximum stroke in the direction b.

The various positions of the parts produced through the positioning of spool 5 occurs as follows: when the spool is in the central position, magnet 21 is energized. Stepping motor 4 is in O-position (O-position limit switch closed). Magnet 21 is deenergized causing the pilot system to be pressureless. Motor 4 can be in any position.

Spool 5 in position a, magnet 21 is energized and motor 4 actuated to rotate in the positive (+) direction. This actuation determines the deflection of the spool 5 and therefore the speed of movement by the piston 26. When the maximum displaced position of spool 5 occurs, a maximum value acts on motor 4 because the spool 5 is at a maximum deflection but does not strike mechanical stops.

Position b of the spool 5 wherein the parts are positioned and energized in the same manner as for position a, just described but the motor 4 is activated in the negative (−) direction.

The control system of the present invention operates with overall efficiency. The system is ready to operate when the pilot valve 3 is supplied with pressurized oil. The consumption of hydraulic power for this mode of operation is, at most, 20W. At full load operation, the consumption of hydraulic power increases to a maximum of 35W.

The main valve 2 does not incur process induced losses. When the main valve 2 is in a central position, the entire delivery of pressurized oil by pump 27 returns unpressurized to tank 31, the loss includes known parameters such as delivery and pressure drop. Upon actuation of the press cylinder 25, only the actual operating pressure is required to be produced. Speed control is effected by way of a by-pass control. When the control system is fully driven, the pressure drop is merely a pressure drop arising out of the nature of the construction of parts.

The positioning speed of the control is enhanced because of the reduced power consumption to obtain a set value and because dynamically higher grade set value stepping motors can be used. Response and adjusting times are correspondingly shorter.

A two-channel activation for emergency stop is achieved. As previously described, the pilot valve 3 must be supplied with pressurized oil for the system to obtain a state of readiness for operation. This supply of pressurized oil is switched ON or OFF by way of the solenoid valve 20. When the magnet or solenoid is in a deenergized state, the spring 6 and 6' operate to move the main valve and spool 5 into a central position and retain the spool in the central position irrespective of the position of the stepping motor 4. The pilot valve 3 is inoperative. In the event of an emergency stop the following two functions will occur; first magnet 21 is deenergized, and secondly, stepping motor 4 is in a zero position. These two functions are initiated simultaneously, thus ensuring a stoppage of the press cylinder piston 26 even without action by a numerical control. After an emergency stop, the zero position of the stepping motor 4 is searched for by means of a zero position limit switch without energizing the solenoid valve 20. Once this basic position has been established, the magnet or solenoid 21 is reenergized and the system is once more ready for operation.

FIGS. 2 and 3 show the construction of parts for a practical form for electrohydraulic control system embodying the present invention. The system includes a main valve 2, pilot valve 3, set value stepping motor 4, link 9 and solenoid valve 20. As in the case of main valve 2, the difference from the diagrammatic view given in FIG. 1 is that instead of a compression spring associated with each end face of the spool, a double acting helical compression spring is provided only on one end face of the main valve spool 5. The spring centers the spool and is stressed more for a deflection of the spool in either the left or right hand directions therefrom.

While the present invention has been described in connection with the preferred embodiments of the various figures, it is to be understood that other similar embodiments may be used or modifications or additions may be made to the described embodiment for performing the same functions of the present invention without deviating therefrom. Therefore, the present invention should not be limited to any single embodiment, but rather construed in breadth and scope in accordance with the recitation of the appended claims.

What I claim is:

1. A control system for a hydraulic drive element, said control system including the combination of:

a pilot valve having a plurality of fluid outlets controlled by a pilot valve spool unidirectionally biased by a resilient spring at one end thereof to a neutral position;

a main valve having an elongated main valve spool resiliently biased to a center position, the opposite ends of said main valve spool being contiguous with individual pressure chambers separately connected to one of said plurality of outlets;

a link engaged with an end of said pilot valve spool which is opposite the end engaged by said resilient spring; and a set value stepping drive coupled to said link for moving said pilot valve spool in either of opposite directions from said neutral position, said link being coupled for movement by said main valve spool to return said pilot valve spool to said neutral position.

2. The control system according to claim 1 wherein said stepping drive includes an electric set value stepping motor.

3. The control system according to claim 1 further including a 4 way, 2 position valve having a closed position wherein pressure medium in feed lines for said pilot valve are closed off and said pressured chambers at opposite ends of the main valve spool are interconnected.

4. The control system according to claim 3 wherein said 4-way, 2 position valve includes a solenoid valve.

5. A control system for a hydraulic drive element, said control system including the combination of:

a pilot valve having a plurality of fluid outlets controlled by a pilot-valve spool unidirectionally biased by a resilient spring at one end thereof to a neutral position;

a main valve having an elongated main-valve spool resiliently biased to a center position, the opposite ends of said main-valve spool being contiguous with individual pressure chambers separately connected to one of said plurality of outlets;

a link engaged with an end of said pilot-valve spool which is opposite the end engaged by said resilient spring;

a set-value stepping drive coupled to said link for moving said pilot-valve spool in either of opposite directions from said neutral position, said link being coupled for movement by said main-valve spool to return said pilot-valve spool to said neutral position;

said pilot valve and said main valve being arranged to extend parallel and adjacent to one another;

said link including a single-armed lever pivotally connected at one end to a rod extending generally transversely of the lever and connected to said main-valve spool;

a central part of said lever engaging with a roller coupled with said pilot-valve spool, and the free end of said lever being connected for movement by said set-value stepping drive in either of opposite directions from a neutral position.

6. The control system according to claim 5 wherein said set value stepping drive includes an electric stepping motor coupled to drive an eccentric having a cam roller for contact with said free end of said lever.

7. The control system according to claim 6 wherein said stepping drive further includes a spring connected for applying a resilient force between said lever and a cam roller spindle for said cam roller.

* * * * *